United States Patent [19]

Grabner

[11] 4,358,092

[45] Nov. 9, 1982

[54] EXOTHERMIC REACTION, SYSTEM FOR SUPPLYING A REACTANT GAS AND A SHIELDING FLUID TO A REACTOR, AND CONTROL SIGNAL GENERATING CIRCUIT FOR USE IN SAID SYSTEM

[75] Inventor: Julius Grabner, Linz, Austria

[73] Assignee: Voest-Alpine Aktiengesellschaft, Linz, Austria

[21] Appl. No.: 177,794

[22] Filed: Aug. 13, 1980

[51] Int. Cl.[3] ..... C21C 5/30

[52] U.S. Cl. ..... 266/82; 75/60; 266/83

[58] Field of Search ..... 266/82, 83; 75/59, 60

[56] References Cited

U.S. PATENT DOCUMENTS

| | | | |
|---|---|---|---|
| 4,047,937 | 9/1977 | Kolb | 75/60 |
| 4,050,681 | 9/1977 | Brotzmann | 75/60 |
| 4,136,857 | 1/1979 | Kolb | 266/86 |
| 4,286,774 | 9/1981 | Benatar | 75/60 |

*Primary Examiner*—P. D. Rosenberg

*Attorney, Agent, or Firm*—Kurt Kelman

[57] ABSTRACT

An exothermic reactor has a refractory lining and a plurality of annular nozzles mounted in said lining. Each nozzle has an inner reactant gas passage and an annular shielding fluid passage surrounding said reactant gas passage. A reactant gas is supplied from a reactant gas manifold through reactant gas feed conduits to respective ones of said reactant gas passages. A shielding fluid is supplied from a shielding fluid manifold through shielding fluid feed conduits to respective ones of said shielding fluid passages. The pressure in said reactant gas manifold is sensed and the flow in each of said shielding fluid feed conduits is controlled in dependence on the conditions in said reactant gas manifold so as to prevent a pressure rise in each of said shielding fluid feed conduits above an upper limit. As long as said pressure is below said upper limit, a predetermined ratio is maintained between the flow rate in each of said shielding fluid feed conduits and the flow rate in said reactant fluid manifold.

7 Claims, 2 Drawing Figures

Figure 1:
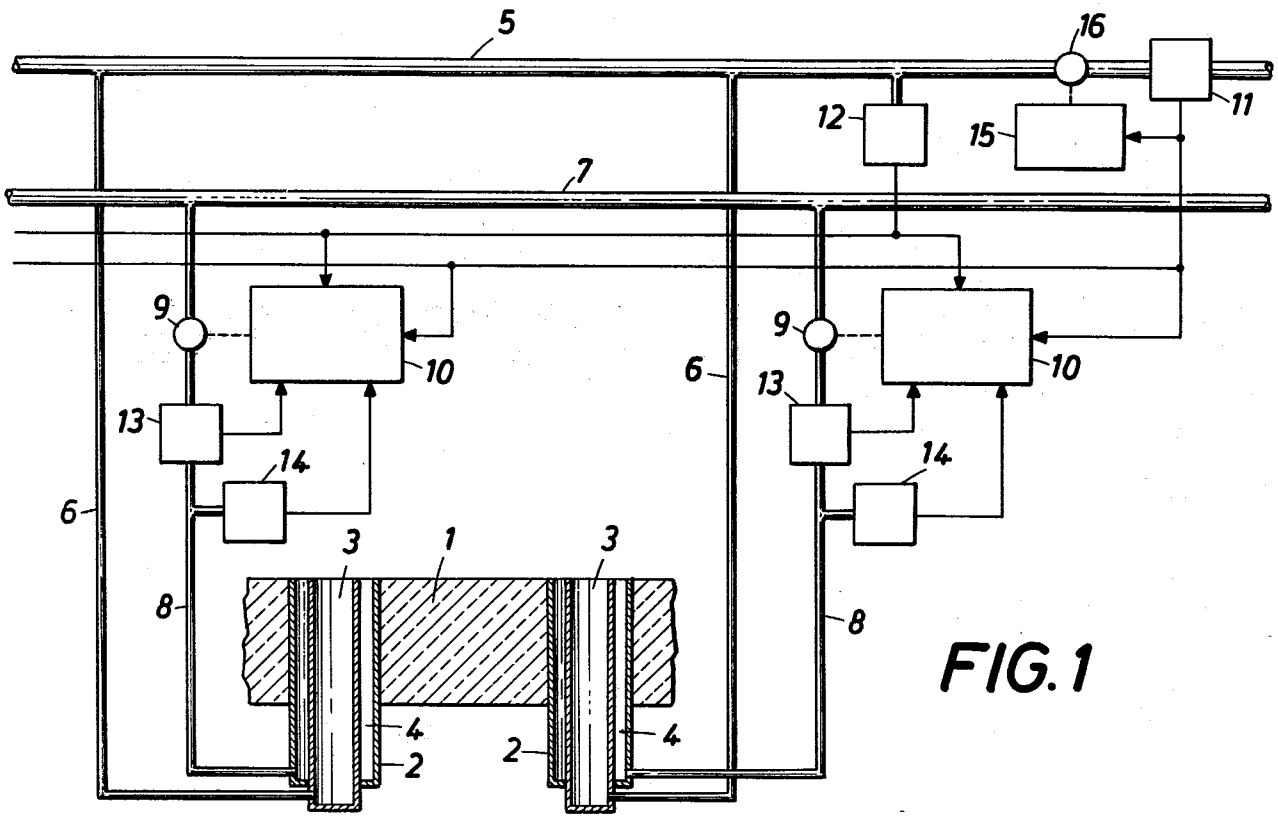

EXOTHERMIC REACTION, SYSTEM FOR SUPPLYING A REACTANT GAS AND A SHIELDING FLUID TO A REACTOR, AND CONTROL SIGNAL GENERATING CIRCUIT FOR USE IN SAID SYSTEM

This invention relates to a system for a controlled supply of a shielding fluid to a plurality of annular nozzles, mounted in the refractory lining of a refining vessel. Each of said annular nozzles defines an inner passage for a refining gas and an annular shielding fluid passage surrounding said inner passage. The inner passages of said nozzles are connected by respective refining gas feed conduits to a refining gas manifold. The annular passages of said nozzles are connected by respective shielding fluid feed conduits to a shielding fluid manifold. The pressure in the shielding fluid feed conduits is controlled in dependence on the pressure in the refining gas manifold.

When ferrous metal is refined by means of oxygen, which is blown into the molten metal through nozzles mounted in the refractory lining of the refining vessel, an overheating of the outlet end of the nozzle and the surrounding refractory must be prevented. For this purpose a shielding fluid in gaseous or liquid form is injected at the same time through annular nozzles, which extend through the refractory lining and define an inner refining gas passage and an annular shielding fluid passage surrounding the refining gas passage. In such a nozzle, the refining gas emerging from the inner refining gas passage may undesirably enter the annular passage for the shielding fluid or the shielding fluid emerging from the annular passage may undesirably enter the inner refining gas passage. A disturbing fire may be ignited in such case if the refining gas consists of pure oxygen and the shielding fluid is combustible and consists e.g., of propane or oil. For this reason the ratios of the pressures and flow rates of the refining gas and shielding fluid supplied to each nozzle should be so controlled that the nozzles will not be clogged by accretion and will not wear at an excessively high rate.

It has already been proposed (U.S. Pat. No. 4,050,681) to control the supply of the shielding fluid to each annular nozzle in dependence on the supply of refining gas by controlling the flow in each of the branch conduits which connect the shielding fluid manifold to respective annular nozzles by a control valve, which is adjusted in dependence on the pressure in the refining gas manifold so that the pressure of the shielding fluid cannot undesirably rise above the refining gas pressure and, as a result, the shielding fluid cannot enter the refining gas passage of an annular nozzle. On the other hand, an ingress of refining gas into the annular passage for the shielding fluid can only be prevented if the pressure in the shielding fluid manifold is so high that the shielding fluid will be under a sufficiently high pressure in the shielding fluid passage when the control valve is opened. Whereas such a pressure control arrangement can prevent a flow of refining gas and shielding fluid into the respective other passage, it will not ensure a uniform distribution of the refining gas and of the shielding fluid to the annular nozzles. To ensure a low wear and a trouble-free operation, the shielding fluid should be uniformly distributed so that the desired ratio of the refining gas and shielding fluid flow rates can be ensured at all nozzles.

It is an object of the invention so to improve a process of the kind described first hereinbefore that a uniform distribution of the refining gas and of the shielding fluid to the several annular nozzles can be ensured.

This object is accomplished according to the invention by controlling the flow rate in each shielding fluid feed conduit in dependence on the flow rate in the refining fluid manifold and the pressure in each shielding fluid feed conduit is kept below an upper limit, which depends on the pressure in the refining gas manifold.

It is apparent that the flow in each shielding fluid feed conduit rather than the pressure is primarily controlled so that a desired ratio of the flow rates of refining gas and shielding fluid can be maintained for each annular nozzle and it is ensured that the shielding fluid will produce the optimum shielding and cooling effects. But a mere flow rate control cannot prevent the pressure of the shielding fluid to rise to such a high value that the shielding fluid emerging from an annular nozzle can enter the refining gas passage of the same nozzle. For this reason the flow rate control is combined with an overriding pressure control, which prevents the pressure in each shielding fluid feed conduit from rising above an upper limit, which depends on the instantaneous refining gas pressure. According to the invention, the pressure control serves merely to keep the pressure in the shielding fluid feed conduits leading to respective annular nozzles at values which are safe in relation to the refining gas pressure so that the flow rate control can be fully effective when the shielding fluid pressure is below its highest permissible value. The conditions which ensure a uniform distribution of the refining gas and of the shielding fluid to the several annular nozzles can thus be maintained with simple means.

The control of the flow rate of the shielding fluid supplied to each annular nozzle in combination with an overriding pressure control can be effected in various ways. For instance, the flow in each shielding fluid feed conduit may be controlled by two control valves connected in series, and one of these control valves may be actuated by a suitable pressure controller and the other by a flow rate controller. But in such an arrangement, an adjustment of one control valve will result in an adjustment of the other control valve because the pressure and the flow rate cannot be changed independently of each other. For this reason it will be more desirable to control the flow in each shielding fluid feed conduit by a single control valve, which is adjustable by a control device which comprises a flow rate controller and a pressure controller. The flow rate controller has a reference input connected to a flow rate sensor for sensing the flow rate in the refining gas manifold and another input connected to a flow rate sensor for sensing the flow rate in the shielding fluid feed conduit. The pressure controller has a reference input connected to a pressure sensor for sensing the pressure in the refining gas manifold and another input connected to a pressure sensor for sensing the pressure in the shielding fluid feed conduit. The pressure control controller and the flow rate control controller are connected to the actuator for the control valve through a minimum-selecting comparator.

In such an arrangement it is ensured in a simple manner that the control valves for controlling the flow in the shielding fluid feed conduits leading to the respective annular nozzles are adjusted by the pressure controller when the pressure of the shielding fluid exceeds the reference value and by the flow rate controller when the pressure of the shielding fluid is below the reference value. The comparator is connected to the flow rate controller and to the pressure controller and ascertains which of the control signals delivered by these controllers corresponds to a smaller flow area of the control valve, and the comparator passes only that control signal to the actuator for the control valve so that the latter is correspondingly adjusted. The other control signal, which corresponds to a larger flow area, is blocked by the comparator. When the shielding gas pressure is less than the highest permissible pressure, the supply of the shielding fluid to each annular nozzle will be controlled by the associated flow rate controller. On the other hand, the control valve will be controlled by the pressure controller as soon as the pressure of the shielding fluid reaches the reference value indicating the highest permissible pressure. The comparator connected to both controllers of the control system thus selects the control signal corresponding to the smaller flow area.

Because the flow rate of the refining gas in the refining gas manifold is proportional to the flow rate of the refining gas in each of the refining gas feed conduits leading to the respective nozzles, as the resistance to the flow of the refining gas adjacent to the annular nozzle varies hardly and differs in this respect from the resistance to the flow of the shielding fluid, the flow rate in the shielding fluid feed conduits leading to the several annular nozzles is controlled in dependence on the flow rate of the refining gas in the refining gas manifold. A desired ratio of the flow rates in the refining gas and shielding fluid feed conduits can be maintained in a simple manner in that the flow rate sensor in the refining gas manifold is connected to the flow rate controller by a preferably adjustable scaling circuit. By means of that scaling circuit, the signal representing the flow rate in the refining gas manifold can be proportionally reduced to represent the flow rate in each of the refining gas feed conduits leading to respective annular nozzles. The ratio of the flow rate in the refining gas manifold and in each refining gas feed conduit may change, e.g., when a nozzle has failed and this change can be taken into account by an adjustment of the scaling circuit.

Similar means may be used to convert the signal representing the pressure in the refining gas manifold to a signal representing the pressure in each refining gas feed conduit. To this end, the pressure sensor in the refining gas manifold is connected to the pressure controller by a preferably adjustable scaling circuit.

Figure 2:
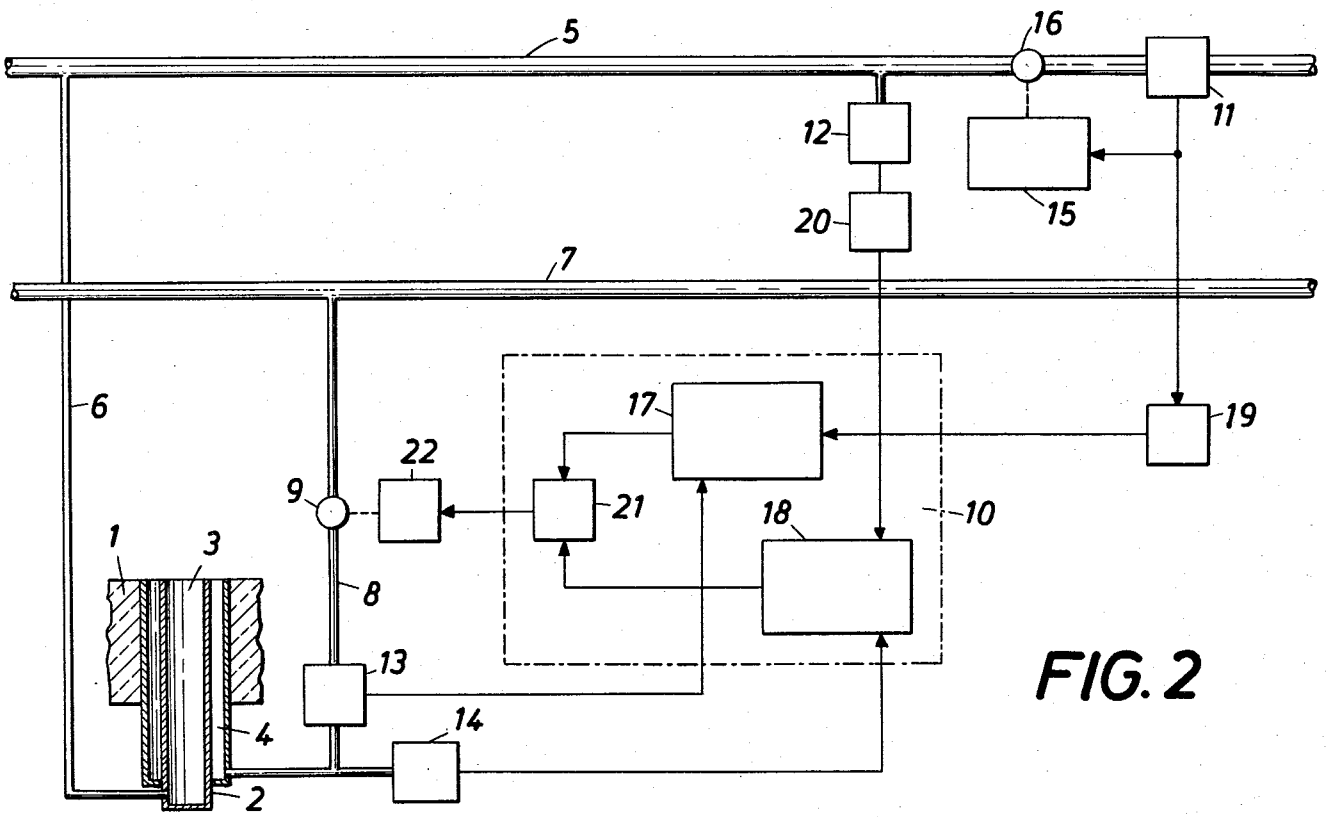

A system according to the invention is shown by way of example in the drawings, in which:

FIG. 1 is a simplified block circuit diagram showing a system according to the invention for a controlled supply of a shielding fluid to a plurality of annular nozzles mounted in the refractory lining of a refining vessel and FIG. 2 is a block circuit diagram showing the basic arrangement of the control system for one of the annular nozzles.

Annular nozzles 2 are mounted in the refractory lining 1 of a refining vessel and consist each of two concentric tubes which define an inner refining gas passage 3 and an annular shielding fluid passage 4 surrounding the refining gas passage 3. A refining gas consisting, e.g., of oxygen is supplied to the refining gas passage 3 of each annular nozzle 2 by one of several feed conduits 6 connected to a refining gas manifold 5. A shielding fluid is supplied to the annular passage 4 of each annular nozzle 2 by one of several feed conduits 8 connected to a shielding fluid manifold 7. To ensure a uniform distribution of the shielding fluid to all annular nozzles 2 in dependence on the refining gas pressure, the flow rate and pressure of the shielding fluid supplied to each annular nozzle 2 are controlled by a control valve 9 connected between the shielding fluid manifold 7 and the respective feed conduit 8. For this purpose, each control valve 9 is actuated by a separate control device 10, which receives a flow rate reference signal from a flow rate sensor 11 for sensing the flow rate in the refining gas manifold 5 and a pressure reference signal from a pressure sensor 12 for sensing the pressure in the refining gas manifold 5. In the control device 10, these reference signals are compared with signals representing the actual flow rate and the actual pressure in the associated shielding fluid feed conduit 8 and delivered by a flow rate sensor 13 and a pressure sensor 14 arranged in the associated feed conduit 8. The control device 10 comprises means for deciding whether the associated control valve 9 is to be controlled in dependence on the flow rate or the pressure in the associated shielding fluid feed conduit 8. A control in dependence on pressure will not be effected unless the pressure detected by the pressure sensor 14 has risen to a value which has a certain ratio to the refining gas pressure sensed by the pressure sensor 12 in the manifold 5 and a further pressure rise in the feed conduit 8 might cause shielding fluid from the annular passage 4 to enter the refining gas passage 3. The pressure sensor 12 determines an upper limit for the pressure in the shielding fluid feed conduits 8. As soon as the pressure in a given feed conduit 8 exceeds that upper limit, the control device 10 will cause the respective control valve 9 to be actuated in a closing sense. When the pressure in a given shielding fluid feed conduit 8 is below the upper limit, the flow rate control will be fully effective and each control valve 9 will then be controlled to maintain a predetermined ratio between the flow rates of refining gas and shielding fluid discharged by each annular nozzle 2. This will ensure that the wear of the annular nozzles 2 and of the surrounding refractory 1 will be slight and uniform.

The refining gas flow rate may be controlled by a suitable controller 15 which actuates a control valve 16 in the refining gas manifold and to which a flow rate signal is delivered by a flow rate sensor 11. Similarly, the flow rate of the shielding fluid in the manifold 7 can be additionally controlled so that the operation of the plant can be continued even when the control devices 10 have failed. In such case, the control valves 9 associated with the feed conduits 8 must be adjusted by hand.

For a simple combination of a flow rate control and an overriding pressure control, the control device 10 shown in FIG. 2 comprises a flow rate controller 17 and a pressure controller 18. The flow rate controller 17 is supplied at a reference input with the output signals of the flow rate sensor 11 and at another input with the output signal of the flow rate sensor 13. The pressure controller 18 is supplied at a reference input with the output signal of the pressure sensor 12 and at another input with the output signal of the pressure sensor 14. Because during undisturbed operation the flow rate and pressure adjacent to the annular nozzles 2 are in a predetermined relation to the rate and pressure in the respective manifold, the reference signals supplied to the flow rate controller and pressure controller, respectively, must be scaled down correspondingly. For this purpose, a scaling circuit 19 is connected between the flow rate sensor 11 and the flow rate controller 17 and a scaling circuit 20 is connected between the pressure sensor 12 and the pressure controller 18.

The control signals delivered by the controllers 17 and 18 are applied to a minimum-selecting comparator circuit 21, which transmits to the actuator 22 for the control valve only that control signal which corresponds to a smaller flow area of the control valve 9 than the other control signal. The control signal which corresponds to a larger flow area is blocked by the comparator circuit 21. In this way, the desired combined flow rate and pressure control is effected. When the pressure which is represented by the signal that is delivered by the pressure sensor 12 via the scaling circuit 20 to the pressure controller 18 exceeds the pressure sensed by the pressure sensor 14, the pressure controller 18 tends to actuate the control valve 9 in an opening sense so that the flow rate control by the flow rate controller 17 can be fully effective unitl the flow rate control tends to open the control valve 9 to such an extent that the pressure in the feed conduit 8 exceeds the reference pressure. In that case, as has been explained hereinbefore, the control valve 9 will not be opened further because the comparator circuit 21 then blocks the control signal delivered by the flow rate controller 17 and transmits only the control signal delivered by the pressure controller. Because the pressure of the refining gas may exhibit large fluctuations, a reference signal depending on the actual refining gas pressure must be applied to the pressure controller.

What is claimed is:

1. A system for supplying a reactant gas and a shielding fluid to a reactor having a refractory lining and a plurality of annular nozzles mounted in said lining, each of said nozzles having an inner reactant gas passage and an annular shielding fluid passage surrounding said reactant gas passage, which system comprises a reactant gas manifold and a plurality of reactant gas feed conduits connected to said reactant gas manifold and adapted to be connected to respective ones of said reactant gas passages, a shielding fluid manifold and a plurality of shielding fluid feed conduits connected to said shielding fluid manifold and adapted to be connected to respective ones of said shielding fluid passages, a reactant gas pressure sensor for sensing the pressure in said reactant gas manifold, and a control system for controlling the fluid flow in said shielding fluid feed conduits, said control system comprising pressure control means responsive to the gas pressure in the reactant gas manifold for preventing a pressure rise in each one of said shielding fluid feed conduits above an upper limit, and flow rate control means for maintaining a predetermined ratio between the flow rate in said shielding fluid feed conduit and the flow rate in said reactant gas manifold as long as said pressure in said shielding fluid feed conduit is below said upper limit.

2. A system as set forth in claim 1, wherein:

said pressure control means comprise, for each of said shielding fluid feed conduits, a fluid pressure sensor for sensing the pressure in the associated shielding fluid feed conduit and a pressure controller, which has a reference input operatively connected to said reactant gas pressure sensor and a second input connected to the shielding fluid pressure sensor for the same shielding gas feed conduit, said pressure controller being adapted to generate a pressure control signal in dependence on said pressure in said reactant gas manifold and the pressure in the associated shielding fluid feed conduit, said flow rate control means comprise a reactant gas flow rate sensor for sensing the flow rate in said reactant gas manifold, and, for each of said shielding fluid feed conduits, a shielding gas flow rate sensor for sensing the flow rate in the associated shielding fluid feed conduit, and a flow rate controller, which has a reference input operatively connected to said reactant gas flow rate sensor and a second input operatively connected to said shielding fluid flow rate sensor for the same shielding gas feed conduit, each of said flow rate controllers being adapted to generate a flow rate control signal in dependence on said flow rate in said reactant fluid manifold and on said flow rate in the associated shielding gas feed conduits, and said control system comprises, for each of said shielding fluid feed conduits, a control valve for controlling the flow in the associated shielding fluid feed conduit, an actuator adapted to receive an actuator control signal and to control the flow area of the control valve for the same shielding fluid feed conduit in a predetermined relation to the magnitude of said actuator control signal, and a comparator adapted to receive said pressure control signal and said flow rate control signal from the pressure and flow rate controllers for the same shielding fluid feed conduit and to deliver to the actuator for the same shielding fluid feed conduit as an actuator control signal only that one of said flow rate and pressure control signals which corresponds to a smaller flow area of the associated control valve.

3. The improvement set forth in claim 2, wherein the reference input of each of said flow rate controllers is connected to said reactant gas flow rate sensor by a scaling device.

4. The improvement set forth in claim 3, wherein said scaling device is adjustable.

5. The improvement set forth in claim 2, wherein the reference input of each of said pressure controllers is connected to said reactant gas pressure sensor by a scaling device.

6. The improvement set forth in claim 5, wherein said scaling device is adjustable.

7. A control signal generating circuit for use in a system for supplying a reactant gas and a shielding fluid to a reactor having a refractory lining, and a plurality of annular nozzles mounted in said lining each of said nozzles having an inner reactant gas passage and an annular shielding fluid passage surrounding said reactant gas passage, which system comprises:

a reactant gas manifold and a plurality of reactant gas feed conduits connected to said reactant gas manifold and adapted to be connected to respective ones of said reactant gas passages, a shielding fluid manifold and a plurality of shielding fluid feed conduits connected to said shielding fluid manifold and adapted to be connected to respective ones of said shielding fluid passages, a reactant gas pressure sensor for sensing the pressure in said reactant gas manifold, and a control system for controlling the fluid in said shielding flow feed conduits said control system comprising for each of said shielding fluid feed conduits a control valve for controlling the flow in the associated shielding fluid feed conduit and an actuator adapted to receive an actuator control signal and to control the flow area of the control valve for the same shielding fluid feed conduit in a predetermined relation to the magnitude of said control signal, said control signal generating circuit comprising for each of said shielding fluid feed conduits a pressure sensor for sensing the pressure in the associated shielding fluid feed conduit and a pressure controller, which has a reference input operatively connected to said reactant gas pressure sensor and a second input connected to the shielding gas pressure sensor for the same shielding fluid feed conduit, said pressure controller being adapted to generate a pressure control signal in dependence on said pressure in said reactant gas manifold and the pressure in the associated shielding fluid feed conduit, said control signal generating circuit further comprising a reactant gas flow rate sensor for sensing the flow rate in said reactant gas manifold, and, for each of said shielding fluid feed conduits, a shielding fluid flow rate sensor for sensing the flow rate in the associated shielding fluid feed conduit, and a flow rate controller, which has a reference input operatively connected to said reactant gas flow rate sensor and a second input operatively connected to said shielding fluid flow rate sensor for the same shielding gas feed conduit, each of said flow rate controllers being adapted to generate a flow rate control signal in dependence on said flow rate in said reactant gas manifold and on said flow rate in the associated shielding fluid feed conduits, and said control signal generating circuit comprising for each of said shielding fluid feed conduits a comparator adapted to receive said pressure control signal and said flow rate control signal from the pressure and flow rate controllers for the same shielding fluid feed conduit and to deliver to the actuator for the same shielding fluid feed conduit as an actuator control signal only that one of said flow rate and pressure control signals which corresponds to a smaller flow area of the associated control valve.

* * * * *